US005114376A

United States Patent [19]

Copley et al.

[11] Patent Number: 5,114,376

[45] Date of Patent: May 19, 1992

[54] TOY ANIMAL WITH ILLUMINATED BELLY

[75] Inventors: Michael C. Copley, La Jolla, Calif.; Cheung Y. Kwai, Mei Foo Sun Kowlon, Hong Kong

[73] Assignee: OTWP, Inc., San Diego, Calif.

[21] Appl. No.: 622,617

[22] Filed: Dec. 5, 1990

[51] Int. Cl.[5] ..... A63H 3/02; A63H 33/26

[52] U.S. Cl. ..... 446/369; 446/485

[58] Field of Search ..... 446/369, 370, 371, 372, 446/175, 484, 485, 295

[56] References Cited

U.S. PATENT DOCUMENTS

| | | | |
|---|---|---|---|
| 2,611,214 | 9/1952 | Schur | 446/485 X |
| 2,614,362 | 10/1952 | Zavala | 446/485 X |
| 2,932,917 | 4/1960 | Patane | 446/485 X |
| 4,464,861 | 8/1984 | Fogarty et al. | 446/370 |
| 4,547,171 | 10/1985 | Horimoto | 446/485 X |
| 4,585,424 | 4/1986 | De Mars | 446/372 X |
| 4,802,879 | 2/1989 | Rissman et al. | 446/295 X |
| 4,836,823 | 6/1989 | Laven | 446/485 |
| 4,858,079 | 8/1989 | Ohashi | 446/485 X |
| 4,867,726 | 9/1989 | Fujimaki | 446/175 |
| 4,874,343 | 10/1989 | Rosenthal | 446/175 |

*Primary Examiner*—David N. Muir

[57] ABSTRACT

A stuffed toy having an animal-shaped body including an illuminatable belly portion. A cavity in the belly portion houses the accessories, electrical circuitry and power source required to provide the illumination source. A dome-shaped member covers the belly cavity and includes an apex aperature. A touch sensor is retained in the apex aperature and is in electrical contact with the power source within the toy belly portion. A timer circuit automatically turns off the illumination source a predetermined time after it has been activated by touching the touch sensor.

16 Claims, 3 Drawing Sheets

TOY ANIMAL WITH ILLUMINATED BELLY

FIELD OF THE INVENTION

This invention relates to toys and is particularly related to stuffed toy animals having illuminated belly.

BACKGROUND OF THE INVENTION

A variety of toys, including stuffed toys, are commonly manufactured in the form of different animal figures such as bears, dogs, cats, dinosaurs as well as other animals. Such toys are mostly popular among children of tender ages either due to their aesthetic appearances or because the feeling of intimacy or security which they induce in such children, particularly at bed time.

Several types of toy animals have been described in various patents and publications, and some are available in the marketplace. For example, U.S. Pat. No. 2,794,298 described and illustrates a toy bear with illuminated eyes. The toy bear described in said patent has two eyes with a neon tube and electrical circuitry associated with each eye designed to illuminate the eye. The electrical circuit also includes resistors having different resistors values to permit the eyes to blink perceptibly and out of phase from one another.

A more recent patent, i.e. U.S. Pat. No. 4,547,171, describes a stuffed toy shaped in the form of a bear which is also useful as a bag for small articles. The stuffed toy bear described in said patent comprises an outer stuffed fabric and an inner frame assembly which is detachably covered by the outer fabric. The inner frame assembly comprises a conical frame member, a cylindrical base member detachably connected at the upper edge to the lower end of the conical frame member and a bottom member detachably connected at the upper edge to the lower edge of the base member. An illumination device is mounted within the inner frame assembly and comprises a power source operatively associated with a lamp for light emitting purpose. A slot and a fastener are provided in the outer stuffed fabric which, when the fastener is opened, permit removal of the inner frame assembly and thus convert the stuffed toy into a useful bag for carrying small articles.

Other patents relating to toy animals which contain illuminating devices include U.S. Pat. Nos. 928,744; 1,300,361; 1,773,834; 2,098,166; 3,226,880; 4,585,424 and 4,752,273. Although this list is by no means exhaustive, it is representative of the state of the art, with most of the patents dealing, in one form or another, with toy animals having illuminated and/or blinking eyes. So far as it is known, there are no patents describing stuffed toys with illuminated belly as disclosed herein.

Therefore, it is an object of this invention to provide a toy in the form of an animal figure having an illuminated belly.

It is a further object of this invention to provide such stuffed animal toys which are aesthetically pleasing and safe to use by children of tender ages.

The foregoing and other objects and features of the present invention will be better understood form the following detailed description with reference to the accompanying drawings.

SUMMARY OF THE INVENTION

In accordance with the present invention, there is provided a stuffed toy having the configuration of an animal such as a bear, a dog and the like. The stuffed toy has a main body which includes an illuminatable belly portion. A cavity is formed in the belly portion to accomodate the structure and accessories designed to provide the illumination of the belly. The belly cavity is covered with a dome-shaped member preferably made of a translucent plastic such as polyethylene. The dome-shaped cover has an apex aperature and an illumination source such as a light bulb which- is retained in said aperature. The light bulb is in electrical contact with a power source within the belly cavity. A printed circuit board in the belly cavity defined the electrical circuitry between the power source (e.g. battery) and the light bulb. A touch sensor retained on the apex aperature when gently pressed by the forefinger activates the electrical circuitry and establishes electrical communication between the power source and the light bulb to illuminate the belly portion.

BRIEF DESCRIPTION OF THE DRAWINGS

In the drawings, wherein like reference numerals are employed to designate like parts.

DETAILED DESCRIPTION OF THE INVENTION

Figure 1:
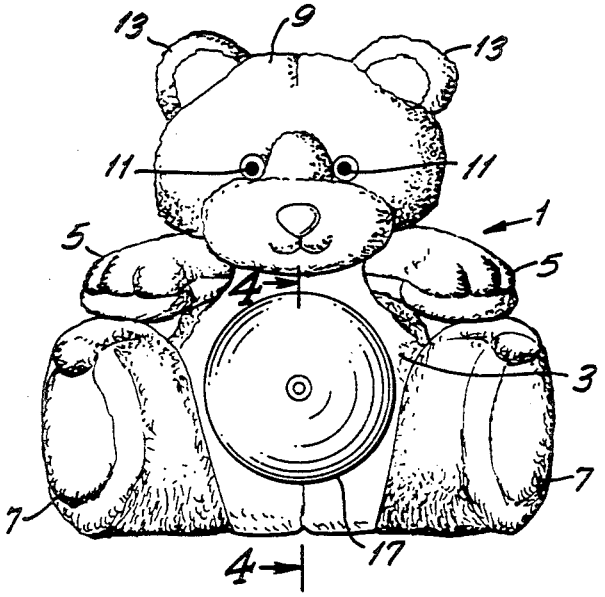
FIG. 1 is a general perspective view of a toy bear constructed in accordance with the present invention having a dome-shaped cover member covering a cavity formed within the toy's belly.
Figure 2:
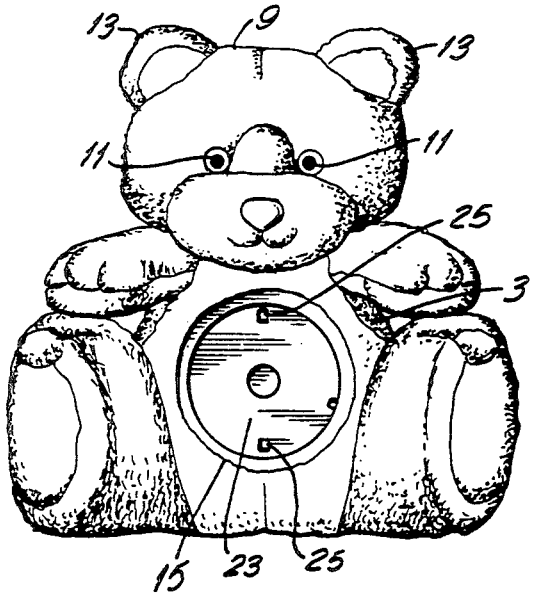
FIG. 2 is a general perspective view similar to FIG. 1 with the cover member removed to show the interior cavity within the belly.

Referring first to FIGS. 1 and 2, the animal toy, depicted here as a bear, is generally designated by the reference numeral 1. The toy bear 1 has a main body 3 and the usual appendages such as arms 5,5, legs 7,7 and head 9 having two eyes 11,11 and ears 13,13. The toy body 3 includes a belly section in which is formed a belly cavity generally designated as 15 which is normally covered with dome-shaped cover member 17. The toy is otherwise formed from an outer hairy skin 19 which is filled with a soft, resilient material 21. It is to be understood however that the materials used in forming the skin enclosure and the inner filler are themselves well known to those skilled in the art of the aforementioned patents.

Figure 2A:
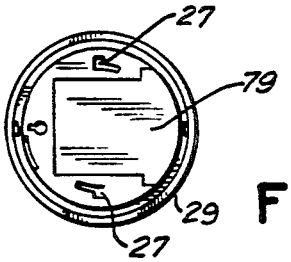
FIG. 2A is a rear view of the base receiving the dome-shaped cover memeber.

A base receiver 23 in the form of a receptacle is force fitted within the belly cavity 15 or it may be securely bonded thereto by a suitable adhesive. A pair of opposed bayonet type male locks 25,25 are formed in the base receiver 23 and securely engage the corresponding bayonet lock openings 27,27 at the rear of the base member 29 (FIG. 2A) thereby securely retaining the base member 29 in the belly cavity 15. The base member 29 is generally formed of a rigid plastic material.

Figure 4:
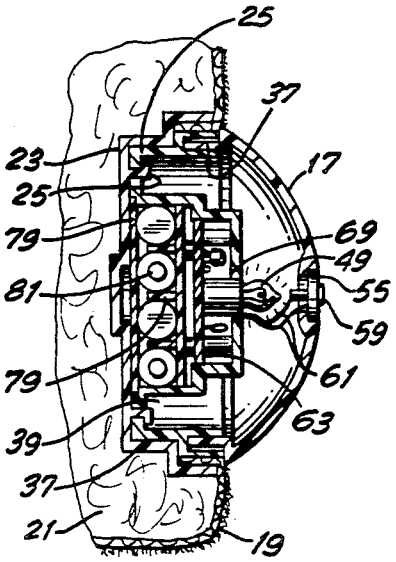
FIG. 4 is a vertical section taken along the line 4—4 in FIG. 1.
Figure 3:
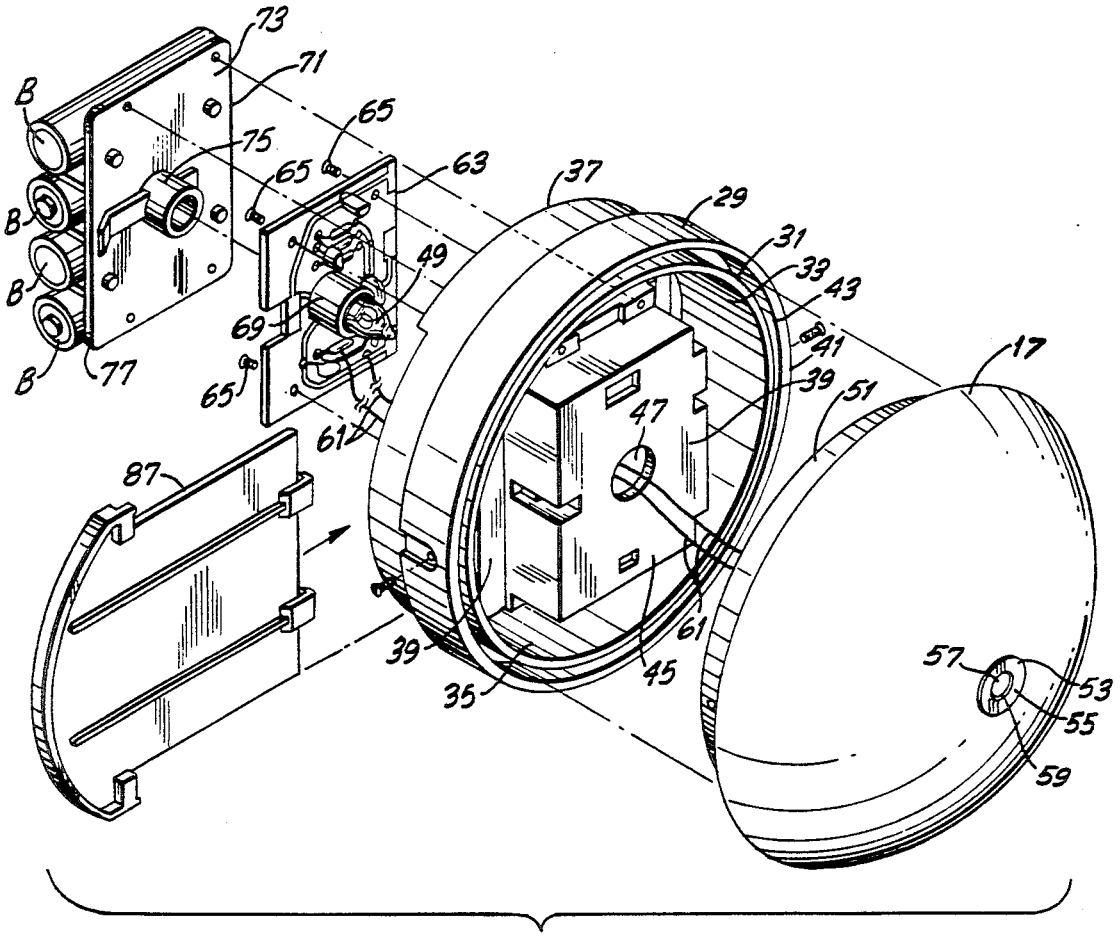
FIG. 3 is an exploded view illustrating the dome-shaped cover member and its base together with the illumination and power source associated therewith.

Referring now to FIGS. 3 and 4, the base member 29 is a molded unitary structure comprising a generally circular dish or cup-shaped member 31 having a base surface 33, a circumferential upstanding edge wall 35 and a reduced circumferential depending flange 37 which houses a compartment 39. Formed about the circumferential edge wall is an outer concentric flange 41 such that the interior wall of said flange 41 defines a circular groove 43 with the outside surface of the adge wall 35. The purpose of the groove 43 will become apparent hereinafter.

The compartment 39 has an outer raised surface 45 which has a central aperature 47 having sufficiant diameter to permit a bulb 49 to be inserted therethrough.

The dome-shaped cover member 17 is usually formed of a plastic material such as polyethylene and the like. The plastic material may be translucent or transparent, although for aesthetic purposes, translucent plastic are preferable so that the interior structures of the belly will not be visible. This enhances the uniform overall appearance of the toy animal.

The dome-shaped cover member 17 has an apex aperature 53 which is slightly recessed in order to seat a washer or a spacer 55 having a central opening 57 through- which is inserted a touch metal sensor 59. A pair electrically conductive wires 61,61 are connected (e.g. by soldering) at one end to the metal sensor 59, and at the other end to a printed circuit board (PCB) as shown in FIG. 3. The PCB 63 is securely positioned within the compartment 37 and is retained therein by the screws 65 which are screwed into their corresponding screw holes. PCB 63 has a central aperature 67 about which is formed a conductive socket 69 in which is seated the bulb 49 by frictionally forcing the bulb stem (not shown) in the socket 69.

As is also shown in FIGS. 3 and 4, and more particularly in FIG. 3, the compartment 39 has associated therewith a battery holder plate 71 which can be snapped into the compartment 39 or screwed therein by known means. The face or front surface 73 of the battery holder plate 71 has a central tubular member 75 formed therein which protrudes from said surface for receiving the stem of the bulb 49 in order to establish electrical contact as hereinafter described. The rear face 77 of the battery holder plate 71 has a plurality of opposed spacers 79 defining battery compartments 81 for holding one or more of the batteries B as desired. The front surface 73 has a conductive metallic contact 85 affixed thereto as shown in FIG. 3 in order to establish electrical contact between the battery power sources and the PCB 63 and ultimately to illuminate the bulb 49. A sliding plate door 87 provides closure for the compartment 39.

Figure 5:
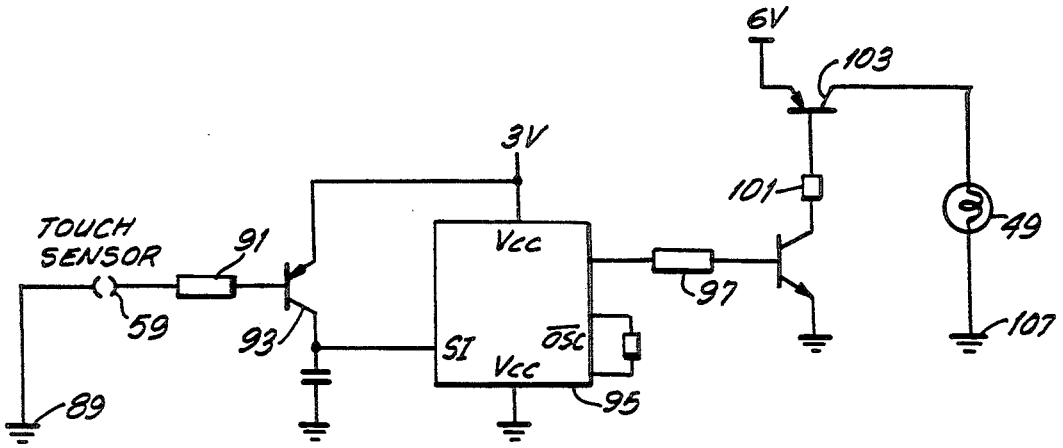
FIG. 5 is an electrical diagram of the electrical circuitry of the printed circuit board (PCB) used in the present invention.

The electrical circuitry of the PCB 63 is shown in FIG. 5. This circuit, including the touch sensor 59 (heat or capacitance sensor) wires 61 and PCB 63 is to enable the child to turn on the bulb in socket 69 by touching the sensor 59. After a predetermined time, the circuit will automatically turn off the bulb or the bulb may be turned off by touching sensor 59 a second time. The automatic shut off time may be conveniently set at 10 minutes, and generally may be within 1 to 20 minutes. Thus, the child, before going to sleep, will touch the sensor 59 to turn on the bulb which will remain lit until the child falls asleep. The bulb will then turn off automatically.

In general, the PCB operates as set forth below. When the sensor 59 is touched, the bulb is immediately turned on. Additionally, a predetermined time is set by the PCB generating a pulse train, in an oscillator, which is similar in digital format to a train of 1-0-1-0-1, etc. The positive pulses (ones) are accumulated in a set of registers. When the registers are full, the last to be filled overflows (producing a control pulse) which turns off the bulb and also empties the registers.

Referring to FIG. 5, the touch sensor 59 is grounded at 89 and is connected through the resistor 91 (10K) to transistor 93 (which may be of type 9012). The collector of transistor 93 is connected to an integrated circuit (IC) 95 described more fully in FIG. 6, and which may be of type RL 3027. The IC 95 is connected through the resistor 97 (15K) to transistor 99 (which may be of type 9014B) whose collector is connected through the resistor 101 (820 ohms) to transistor 103 (which may be of type 8550) which, in turn, is connected through bulb socket 69 (6 volts) to the ground 107.

Figure 6:
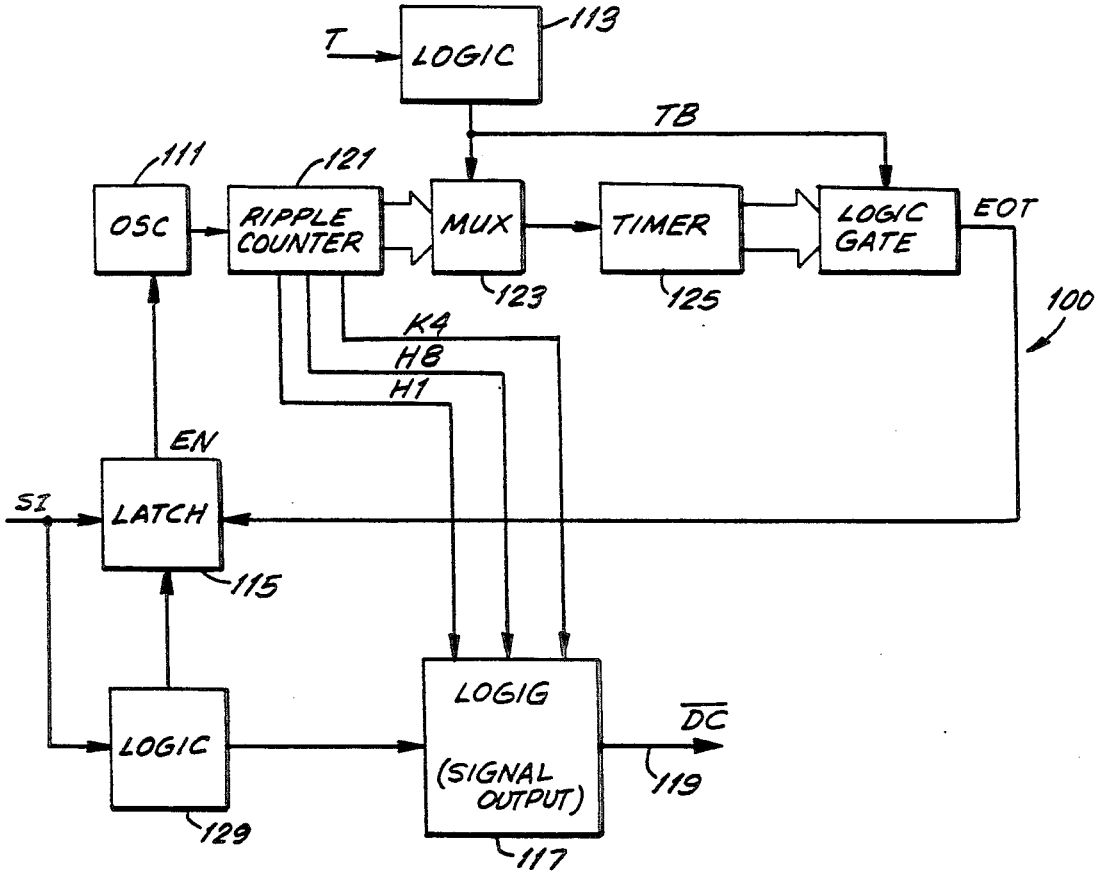
FIG. 6 is a block diagram illustraing the time delay electrical circuit used to turn off the bulb in the toy's belly.

Referring now to the block diagram in FIG. 6:

T is made high to select the counting period (e.g., 10 minutes);

TB is time base (the clock);

EOT is end of time;

EN is enable signal to control the oscillator 111. Low disables the oscillation in order to stop the counting before the EOT;

SI is rising edge trigger input, produced by the touch sensor 59 and toggles to switch the oscillator 111 on or off;

DC is a negative direct current output to turn on the lamp 49, and

H1, K4 and H8 are control signals.

The predetermined automatic shut-off time (delay) is set by T which is assigned with high level or low level during assembly. T sets the logic 113 which determines the time base TB, counting fast or slow, and determines the length of the counting period (automatic shut off period). As previously mentioned, the shut off time period is preferably 10 minutes, but may generally range from 1 to 20 minutes.

Thus, when the batteries are connected, the circuit 100 is turned on. However, there is no oscillation of the oscillator 111 in order to save the battery-. When the sensor 59 is touched, there is an output derived from the sensor and amplified (desigated as SI in FIG. 6). SI operates the latch 115 and EN will turn to high level from latch 115. EN signal will activate the oscillator 111 and the signal output logic 117. The signal output logic 117 will activate the DC output 119 and the bulb is thus turned on. The oscillator 111 will generate a pulse train to the ripple counter 121 where the pulse train is divided to three separate pulse trains H1, K4 and H8. These signals (H1, K4 and H8) are the outputs to the multiplexer (MUX) 123 and to the logic 117.

In the MUX 123, the three separate pulse trains H1, K4 and H8 are combined into a single pulse train as a clock base. The clock base is the input to the timer 125 which is made up of pulse registers. If the counting is not interrupted, the clock pulse will be fed into the registers and stored. When the last to be filled register overflows, the timer 125 will generate a signal to the logic gate 127 and the logic gate 127 will give out EOT signal to the latch 115. The latch 115 will then disable the EN signal which in turn disables the oscillator 111. Once the oscillator 111 is stopped, the ripple counter 121 is stopped and the pulse trains H1, K4 and H8 are interrupted. The logic 117 and its output DC 119 will be disabled and the bulb is thus turned off.

If it is desired to turn off the bulb before the predetermined set time the user touches sensor 59 and another SI input is generated. If there is another SI input during counting, the latch 115 will directly operate logic 129 and also interrupt the oscillation of oscillator 111 as hereinbefore described and, ultimately, the DC 119 is disabled and the lamp is turned off. In other words, a second SI will have the same effect as the EOT signal.

Although the invention has been described with certain degree of particularity, several changes and modifications may be made which are obvious from this description. Such changes and modifications are nevertheless within the scope if this invention.

What is claimed is:

1. A stuffed toy having a main body configured as an animal, said body having an illuminatable belly portion, comprising in combination:

(a) a generally circular cavity formed in said belly portion, (b) a generally circular housing conformally fitting securely within said cavity, (c) an annular member having a reduced peripheral, generally circular base adapted to friction fit within said housing, (d) a dome-shaped cover member adapted to coextensively cover said cavity in said belly portion, said domed-shaped cover member having an apex aperture, (e) an illumination means retained in said housing, (f) a switch means to turn on said illumination means, said switch means being retained in said apex aperture, (g) a circuit means to be activated by said switch means to automatically turn off said illumination means after a predetermined time, and (h) a power source in said housing in electrical contact with said illumination means and said circuit means, said power source being operatively connected to illuminate said illumination means.

2. A stuffed toy as in claim 1 further including as said switch means a touch sensor retained in said apex aperature wherein said sensor is in electrical contact with said power source.

3. A stuffed toy as in claim 1 further including a printed circuit board in said housing, said printed circuit board being in electrical contact with said illumination means and said power source.

4. A stuffed toy as in claim 2 further including a printed circuit board in said housing, said printed circuit board being in electrical contact with said illumination means and said power source.

5. A stuffed toy as in claim 1 wherein said dome-shaped cover is formed of a translucent plastic.

6. A stuffed toy as in claim 2 wherein said dome-shaped cover is formed of a translucent plastic.

7. A stuffed toy as in claim 3 wherein said dome-shaped cover is formed of a translucent plastic.

8. A stuffed toy as in claim 4 wherein said dome-shaped cover is formed of a translucent plastic.

9. A stuffed toy having a main body configured as an animal, said body having an illuminatable belly portion, comprising, in combination:

(a) a generally circular cavity formed in said belly portion, (b) a generally circular housing conformally fitting securely within said cavity, said housing comprising a generally circular base member comprising a generally cup-shaped portion, a base, and a circumferential edge wall upstanding from said base, (c) an outer annular member having a reduced peripheral, generally circular base adapted to friction fit within said cup-shaped portion in said housing, and a reduced upper annular member concentric with said outer annular member so as to define a circumferential groove therewith, (d) a dome-shaped cover member having reduced integral circumferential lip adapted to frictionally fit within said groove, said dome-shaped cover member having an apex aperture.

(e) an illumination means retained in said housing, and (f) a power source in said housing in electrical contact with said illumination means, said power source being operatively connected to illuminate said illumination means.

10. A stuffed toy as in claim 9 further including a touch sensor retained in said apex aperature wherein said sensor is in electrical contact with said power source.

11. A stuffed toy as in claim 9 further including a printed circuit board in said housing, said printed circuit board being in electrical contact with said illumination means and said power source.

12. A stuffed toy as in claim 10 further including a printed circuit board in said housing, said printed circuit board being in electrical contact with said illumination means and said power source.

13. A stuffed toy as in claim 9 wherein dome-shaped cover is formed of a translucent plastic.

14. A stuffed toy as in claim 10 wherein said dome-shaped cover is formed of a translucent plastic.

15. A stuffed toy as in claim 11 wherein said dome-shaped cover is formed of a translucent plastic.

16. A stuffed toy as in claim 12 wherein said dome-shaped cover is formed of a translucent plastic.

* * * * *